United States Patent [19]

Hafner

[11] 4,413,244

[45] Nov. 1, 1983

[54] ELECTROMAGNET

[75] Inventor: Udo Hafner, Lorch, Fed. Rep. of Germany

[73] Assignee: Robert Bosch GmbH, Stuttgart, Fed. Rep. of Germany

[21] Appl. No.: 362,370

[22] Filed: Mar. 26, 1982

[30] Foreign Application Priority Data

Mar. 26, 1981 [DE] Fed. Rep. of Germany ..... 3111938

[51] Int. Cl.[3] ..... H01F 7/10

[52] U.S. Cl. ..... 335/250; 339/176 R

[58] Field of Search ..... 339/189 R, 75 M, 176; 335/250, 299, 220

[56] References Cited

U.S. PATENT DOCUMENTS 2,889,497 6/1959 Wolf et al. ..... 335/299
3,121,599 2/1964 Modrey ..... 339/189 R
3,166,692 1/1965 Forrester et al. ..... 335/250
3,487,403 12/1969 Pihl ..... 335/220

*Primary Examiner*—Harold Broome
*Attorney, Agent, or Firm*—Edwin E. Greigg

[57] ABSTRACT

An electromagnet is proposed which serves in particular for actuating a fuel injection valve for fuel injection systems of internal combustion engines. The electromagnet includes a housing and a magnetic coil mounted on a core. The supply of electric current to the magnetic coil is effected via contact prongs, which protrude via insulating inserts into the housing and whose ends are yieldingly surrounded by loops embodied on contact lugs. The contact lugs are disposed on the carrier body and on the other end are electrically conductively connected with the wire ends of the magnetic coil.

4 Claims, 2 Drawing Figures

44
4
3
22
84
43
2
83
63
41
23
24
5
25
71
20
46
46
82
70
65
70
45
62
16
67
7
19
81
81
II
II
64
18
68
26
17
26
68
66
69
39
15
36
40
9
M
37
50
52
1
49
8
75
10
28
11
29
74
48
12
73
52
31
13
35
34
73
38
51
33
32
30
54
59
58
55
56
60
57

ELECTROMAGNET

BACKGROUND OF THE INVENTION

The invention is based on an electromagnet as generally described hereinafter. In an electromagnet which is already known, however, the electrical connection between contact prongs protruding from the housing and the magnetic coil is effected by welding or soldering. The disadvantage of this is that it is not possible to fabricate the housing and the magnetic coil separately.

OBJECT AND SUMMARY OF THE INVENTION

The electromagnet according to the invention has the advantage over the prior art that after a separate fabrication of the housing and the magnetic coil, contact between the contact prongs and the magnetic coil is automatically established during assembly.

It is particularly advantageous that the contact prongs are fused into glass, so that it is assured that the passageways for the prongs will be tightly sealed.

The invention will be better understood and further objects and advantages thereof will become more apparent from the ensuing detailed description of a preferred embodiment taken in conjunction with the drawings.

DESCRIPTION OF THE PREFERRED EMBODIMENT

Figure 1:
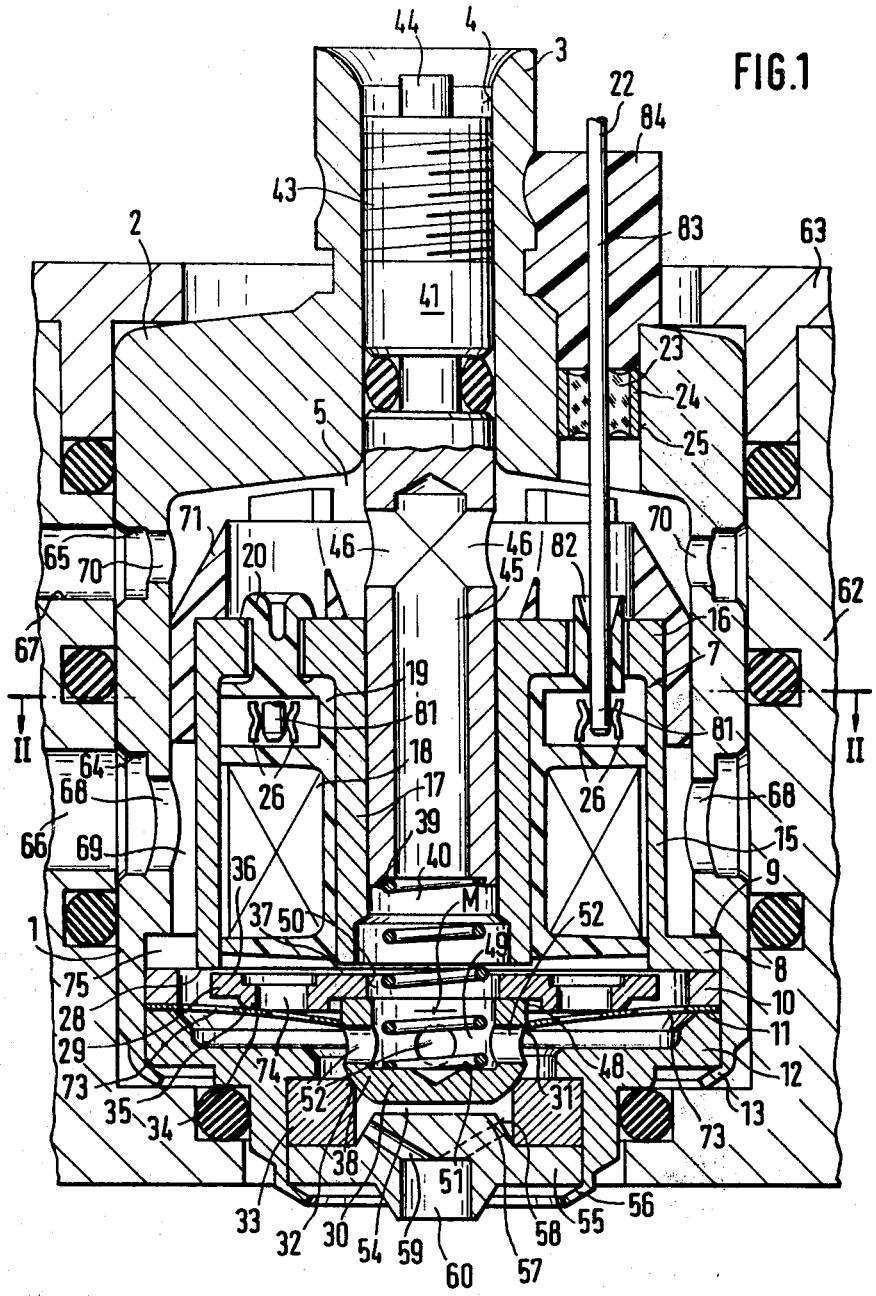
FIG. 1 shows a cross sectional view of a fuel injection valve in simplified form, with an electromagnet embodied in accordance with the invention.

The fuel injection valve shown in FIG. 1, which is intended for a fuel injection system, serves by way of example to inject fuel, in particular at low pressure, into the intake tube of mixture-compressing internal combustion engines with externally supplied ignition. A valve housing 1 is fabricated by a non-cutting shaping method, such as deep drawing, rolling and the like; it has a cup-shaped form with a bottom 2, from which a tubular guide fitting 3 protrudes. The guide fitting 3 has a guide bore 4, which likewise passes through the base 2 and discharges in the interior of the valve housing 1. A shell core 7 of ferromagnetic material is inserted into the interior 5 of the housing 1. The shell core 7 has a smaller diameter than does the interior 5 and rests with a shoulder 8 on an inner step 9 of the valve housing 1. A spacer ring 10 engages the side of the shoulder 8 remote from the inner step 9. The spacer ring 10 is adjoined in sequence by a guide diaphragm 11 and then a nozzle carrier 12, with a crimped edge 13 engaging the end face of the nozzle carrier 12 by partially surrounding it and exerting an axial stress on the nozzle carrier. This axial stress assures the positional fixation of the shell core 7, the spacer ring 10, the guide diaphragm 11 and the nozzle carrier 12. A conventional shell-type core of type T 26 made by Siemens may be used as the shell core 7; this has an annular outer core 15 and an annular inner core 17 connected to the outer core via a crosspiece 16. A magnetic coil 18 is surrounded at least partially by an insulating carrier body 19, which is inserted together with the magnetic coil 18 into the annular chamber of the shell core 7 formed between the outer core 15 and the inner core 17 and is connected in a positively engaged manner with the crosspiece 16, for instance by means of rivets 20 or by a releasable snap-lock connection. The rivet 20 is shown rotated into the plane of the drawing in FIG. 1.

Figure 2:
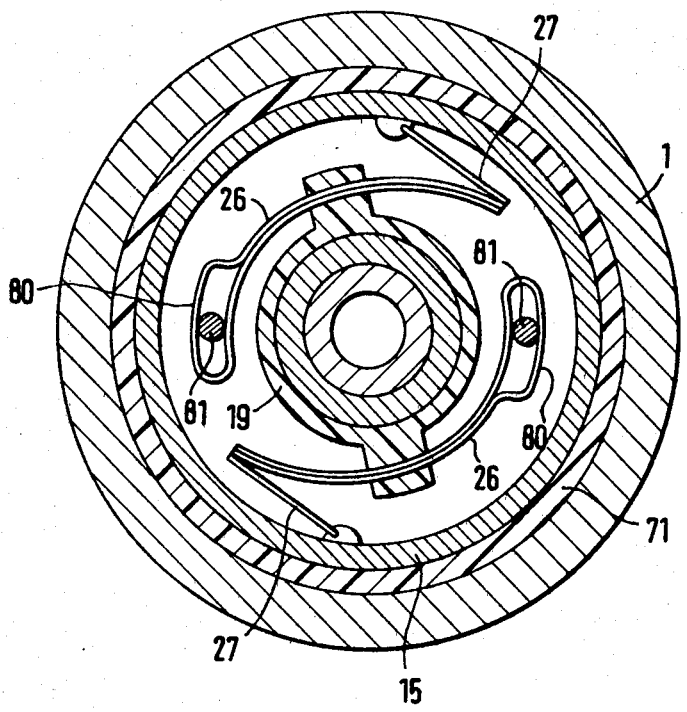
FIG. 2 is a sectional view taken along the line II—II of FIG. 1.

The supply of electric current to the magnetic coil 18 is advantageously effective via contact prongs 22, only one of which is shown, which are embedded in an insulating insert 23 of glass, for example. The insulating insert 23 may be surrounded by a fastening ring 24 which is sealingly inserted into an open bore 25 of the valve housing bottom 2 and fixed in place by soldering, for example. Either plug connections or electric cables may be connected with the contact prongs 22 in a manner which is known but not illustrated here. As also shown in FIG. 2, contact lugs 26 are disposed on the carrier body 19; they are made of an electrically conductive, band-like material and are yieldingly connected at one end with wire ends 27 of the magnetic coil. The free ends of the contact lugs 26 are formed into loops 80 (See FIG. 2), which in a yielding manner at least partially surround the contact prong ends 81 in order to effect contacting. One centering opening 82 oriented toward each contact prong 22 is provided on the carrier body 19. The centering opening 82 extends in a conically tapering manner toward the contact prong ends 81 and directs each contact prong end 81 to the associated loop 80. The described pressure contact effected between the contact prongs 22 and the contact lugs 26 via the yielding loops 82 has the advantage that the housing 1 and the magnetic circuit 7, 18, 19 can be fabricated separately, and during assembly the magnetic circuit 7, 18, 19 can be inserted into the housing 1, whereupon the electrical contact is effected by way of the pressure contact between the contact prongs 22 and the loops 80. The contact prong end 83 protruding out from the housing may be surrounded with a sprayed-on plastic jacket 84, which protects it from extreme bending and can act as a plug body or surrounds an abutting cable.

A flat armature 29 is disposed between the end face 28 of the shell core 7 remote from the crosspiece 16 and the guide diaphragm 11. In the middle part of the flat armature 29, a movable valve part 30 is connected with the flat armature, being soldered or welded, for example. The valve element 30 passes through a central guide opening 31 in the guide diaphragm 11 and cooperates with a fixed valve seat 32, which is embodied within a valve seat body 33. The valve seat body 33 is inserted into the nozzle carrier 12. The valve element 30 and the flat armature 29 are guided in the radial direction by means of the central guide opening 11 of the guide diaphragm 11, on the one hand relative to the valve seat 32 and on the other relative to the end face 28 of the shell core 7. The guide diaphragm 11 is not connected rigidly either with the valve element 30 or with the flat armature 29. The flat armature may be embodied as a stamped or pressed part and may, for instance, have an annular guide crown 34 oriented toward the guide diaphragm 11. The guide crown 34 firstly improves the rigidity of the flat armature 29; secondly, it separates a first work area 36 of the flat armature, oriented toward the end face of the outer core 15, form a second work area 37, oriented toward the end face of the inner core 17, and thirdly, it forms a guide edge 35, which rests on the guide diaphragm 11, as a result of which the flat armature 29 is guided in a plane-parallel manner to the end face 29 of the shell core 7. The valve element 30 has a spherical section 38 cooperating with the valve seat 32 and embodied by way of example as a spherical zone which has been flattened somewhat. The guide diaphragm 11 is clamped between the spacer ring 10 and the nozzle carrier 12 in a plane which, when the valve element 30 is resting on the valve seat 32, extends through the center M or as close as possible to the center point M of the spherical section 38. When the valve element 30 is resting on the valve seat 32, the guide diaphragm 11 is curved by tension on the guide edge 35 of the flat armature 29. The valve element 30 is urged in the closing direction of the valve by a compression spring 39, which is supported at the other end in an inner bore 40 of the shell core 7 and is supported on a slide member 41. The force of the compression spring 39 on the flat armature 29 and the valve element 30 can be influenced by means of axially displacing the slide member 41.

On its end remote from the flat armature, the slide member 41 is pressed into the guide bore 4 from the bottom 2 and the guide fitting 3, and in the vicinity of the guide fitting 3 the slide member 41 has a section with notches 43, for instance annular grooves, windings, knurling or the like, in order to assure better axial fixation of the slide member 41; that is, the guide fitting 3 is pressed inward in the area of the notches 43, so that material from the guide fitting 3 is forced into the notches 43 of the slide member 41. The end of the slide member 41 remote from the flat armature 29 is embodied such that it terminates inside the guide fitting 3 and has a tang 44 whose diameter is smaller than that of the guide bore 4. A suitable tool is capable of engaging the tang 44 in order to displace the slide member 41. The slide member 41 has a longitudinal bore 45 open in the direction of the flat armature 29; on the other end, this bore 45 discharges outside the shell core 7 with the transverse bores 46 leading to the circumference of the slide member 41 in the interior 5 of the valve housing 1.

The valve element 30 has a cylindrical section 48 connected to the flat armature 29, and the spherical section 38 of the valve element is adjacent to this cylindrical section 48. The valve element 30 is provided with a concentric blind bore 49 which is open in the direction of the flat armature 29 and reaches as far as possible into the spherical section 38. The compression spring 39 resting on the slide member 41 on one end passes through an opening 50 of the flat armature and is supported at the other end, in the valve element 30, on the bottom 51 of the blind bore 49; as a result, when the magnetic circuit 7, 18, 19, 29 is not excited, the valve element 30 is held on the valve seat 32, counter to the spring force of the guide diaphragm 11, such that it effects sealing. Transverse bores 52 extend from the circumference of the valve element 30 to the blind bore 49.

Downstream of the valve seat 32, there is a collecting chamber 54, whose capacity should be as small as possible, and which is defined by the valve seat body 33, the spherical section 38 and a spin body 55 disposed downstream of the valve seat body 33. A flange 56 of the nozzle carrier 12 surrounds and engages a face of the spin body 55 remote from the valve seat body 33, as a result of which the valve seat body 33 and the spin body 55 are fixed in their relative positions. The spin body 55 has a protrusion 57 protruding into the collecting chamber 54, and the end face of the protrusion 57 oriented toward the valve element 30 is flattened. The protrusion 57 has a lateral peripheral wall 58, which extends in conical fashion, for instance, and branching off from it are spin conduits 59 which are open in the direction of the collecting chamber 54; in a known manner, these conduits may be inclined at an angle to the valve axis and they discharge into a spin chamber 60. The spin conduits 59 may discharge into the spin chamber 60 at a tangent, for instance, and they serve to meter the fuel. The fuel film forming at the wall of the spin chamber 60 is severed at the sharp end of the spin chamber 60, which discharges into the intake tube, and thus takes a conical form as it enters into the flow of air in the intake tube; as a result, good preparation of the fuel is assured, particularly at relatively low fuel pressures.

The fuel injection valve, supported in a holder body 62, may for example be fixed in position by a claw or a cap 63 and in the housing 1 it has a first annular groove 64 and a second annular groove 65 which is offset in the axial direction and sealed off from the first annular groove 64. A fuel inlet line 66 is formed in the holder body 62 and discharges into the first annular groove 64. A fuel return flow line 67 is furthermore embodied in the holder body 62 and communicates with the second annular groove 65. Radial inlet openings 68 in the wall of the cylindrical, tubular portion of the valve housing 1 connect the first annular groove 64 with a flow conduit 69, which is embodied between the outer core 15 and the inner wall of the valve housing 1. The portion of the interior 5 located above the shell core 7 communicates with the second annular groove 65 via radially extending discharge openings 70 formed in the cylindrical, tubular portion of the valve housing 1 and is separated from the flow conduit 69 by a sealing body 71. The guide diaphragm 11 has flowthrough openings 73, and flowthrough openings 74 may also be embodied in the flat armature 29. Fuel flowing into the flow conduit 69 via the inflow openings 68 is capable of flowing via openings 75 in the shoulder 8 and the flowthrough openings 73 in the guide diaphragm 11 to the valve seat 32, from whence it passes into the collecting chamber 54, when the valve element 30 is lifted up from the valve seat 32; in the collecting chamber 54, the fuel is metered via the spin conduits 59. The non-metered portion of the fuel can flow via the transverse bores 52 into the blind bore 49 of the valve element 30 and from there via the inner bore 40 or the longitudinal bore 45 of the slide member 41 and the transverse bore 46 into the portion of the interior 5 located above the shell core, meanwhile absorbing the heat created in the magnetic circuit; from there, the non-metered fuel can flow out via the discharge openings 70 and the second annular groove 65 into the fuel return flow line 67.

The foregoing relates to a preferred exemplary embodiment of the invention, it being understood that other embodiments and variants thereof are possible within the spirit and scope of the invention, the latter being defined by the appended claims.

What is claimed and desired to be secured by Letters Patent of the United States is:

1. A housed electromagnet device for the actuation of a fuel injection valve for fuel injection systems of internal combustion engines, a carrier body having a magnetic coil mounted on a core of ferromagnetic material and an armature, said device further including a supply of electric current to said magnetic coil via contact prongs which protrude into said housing and are connected with said magnetic coil in an electrically conductive manner, characterized in that said housing is further provided with means defining an opening through which electrical contact means is arranged to extend, a conically tapering centering opening in said carrier body for the protrusion of said contact means therethrough, said electrical contact means having at least a terminus which engages fully enclosed loop elements provided on said magnetic coil, and said loop elements at least partially encircling said terminus of said electrical contact means, whereby said terminus of said electrical contact means is brought into engagement with said loop elements.

2. An electromagnet as defined by claims 1, characterized in that said means defining said opening in said housing is provided with an insulating insert.

3. An electromagnet as defined by claim 2, characterized in that said insulating insert is fused into contact with said electrical contact means.

4. An electromagnet as defined by claim 3, characterized in that said electrical contact means enters a plastic jacket which is positioned in said housing in proximity to said insulating insert.

* * * * *